US006758659B2

(12) United States Patent
Ni

(10) Patent No.: US 6,758,659 B2
(45) Date of Patent: Jul. 6, 2004

(54) SCROLL TYPE FLUID DISPLACEMENT APPARATUS WITH FULLY COMPLIANT FLOATING SCROLLS

(76) Inventor: Shimao Ni, 8538 Thistlewood Ct., Darien, IL (US) 60516

( * ) Notice: Subject to any disclaimer, the term of this patent is extended or adjusted under 35 U.S.C. 154(b) by 0 days.

(21) Appl. No.: 10/342,954

(22) Filed: Jan. 14, 2003

(65) Prior Publication Data

US 2003/0194340 A1 Oct. 16, 2003

Related U.S. Application Data

(60) Provisional application No. 60/371,998, filed on Apr. 11, 2002.

(51) Int. Cl.[7] ..... F01C 1/04

(52) U.S. Cl. ..... 418/55.2; 418/55.3; 418/55.5; 418/60; 418/151

(58) Field of Search ..... 418/55.2, 55.3, 418/55.5, 60, 151

(56) References Cited

U.S. PATENT DOCUMENTS

| | | | | |
|---|---|---|---|---|
| 1,041,721 A | | 10/1912 | Ball | |
| 2,475,247 A | | 7/1949 | Mikulasek | |
| 2,494,100 A | | 1/1950 | Mikulasek | |
| 3,011,694 A | | 12/1961 | Audemar | |
| 3,560,119 A | | 2/1971 | Busch et al. | |
| 3,600,114 A | | 8/1971 | Dvorak et al. | 418/57 |
| 3,802,809 A | | 4/1974 | Vulliez | 418/60 |
| 3,817,664 A | | 6/1974 | Bennett et al. | 418/60 |
| 3,924,977 A | * | 12/1975 | McCullough | 418/55.5 |
| 3,989,422 A | | 11/1976 | Güttinger | 418/60 |
| 4,192,152 A | | 3/1980 | Armstrong et al. | 418/5 |
| 4,558,997 A | | 12/1985 | Sakata et al. | 418/55.2 |
| 4,677,949 A | | 7/1987 | Youtie | 418/60 |
| 4,731,000 A | | 3/1988 | Haag | 418/57 |
| 4,990,071 A | | 2/1991 | Sugimoto | 418/55.2 |
| 5,098,265 A | | 3/1992 | Machida et al. | 418/55.2 |
| 5,171,140 A | | 12/1992 | Schäfer et al. | 418/60 |
| 5,197,868 A | | 3/1993 | Caillat et al. | 418/55.5 |
| 5,247,795 A | | 9/1993 | McCullough | 418/60 |
| 5,304,047 A | | 4/1994 | Shibamoto | 418/60 |
| 5,322,426 A | | 6/1994 | Kolb | 418/60 |
| 5,556,269 A | | 9/1996 | Suzuki et al. | 418/60 |
| 5,616,015 A | | 4/1997 | Liepert | 418/60 |
| 5,624,247 A | | 4/1997 | Nakamura et al. | 418/60 |
| 5,632,611 A | | 5/1997 | Sekiya et al. | 418/55.2 |
| 5,690,480 A | | 11/1997 | Suzuki et al. | 418/55.2 |
| 5,755,564 A | | 5/1998 | Machida et al. | 418/60 |
| 5,775,893 A | | 7/1998 | Takao et al. | 418/60 |
| 5,788,470 A | | 8/1998 | Okuda et al. | 418/60 |
| 5,855,473 A | | 1/1999 | Liepert | 418/60 |
| 5,961,297 A | | 10/1999 | Haga et al. | 418/5 |
| 6,068,459 A | | 5/2000 | Clarke et al. | 418/55.4 |
| 6,123,529 A | | 9/2000 | Kawano et al. | 418/55.2 |
| 6,290,477 B1 | | 9/2001 | Gigon | 418/55.2 |

* cited by examiner

*Primary Examiner*—John J. Vrablik
(74) *Attorney, Agent, or Firm*—Merchant & Gould P.C.

(57) ABSTRACT

The invention includes a "floating scroll" mechanism for scroll type fluid displacement apparatus. The dual orbiting scroll has spiral vanes on both sides of the end plate. In a floating scroll, the orbiting scroll is dynamically well balanced, axially and radially. The scrolls are fully or semi-axially and radially compliant for maintaining minimum contacting forces between components, hence achieving good sealing for high speed, high efficiency, low friction wear and power loss. A crank shaft-sliding knuckle and/or peripheral crank handles-sliding knuckle mechanism provide the dual orbiting scroll with radial compliant capability. A synchronizer is used to synchronize the orientation of the crank handles to avoid the mechanism from jamming during operation and start up.

33 Claims, 10 Drawing Sheets

SCROLL TYPE FLUID DISPLACEMENT APPARATUS WITH FULLY COMPLIANT FLOATING SCROLLS

RELATED APPLICATION

This application claims the benefit of U.S. Provisional Application No. 60/371,998, filed Apr. 11, 2002.

BACKGROUND OF THE INVENTION

This invention relates to a scroll-type positive fluid displacement apparatus and more particularly to a scroll-type apparatus having a fully compliant, i.e. axially and radially compliant, floating scroll mechanism.

There is known in the art a class of devices generally referred to as "scroll" pumps, compressors and expanders, wherein two interfitting spiroidal or involute spiral elements are conjugate to each other and are mounted on separate end plates forming what may be termed as fixed and orbiting scrolls. These elements are interfitted to form line contacts between spiral elements.

A pair of line contacts and the surfaces of end plates form at least one sealed off pocket. When one scroll, i.e. the orbiting scroll, makes relative orbiting motion, i.e. circular translation, with respect to the other, the line contacts on the spiral walls move along the walls and thus changes the volume of the sealed off pocket. The volume change of the pocket will expand or compress the fluid in the pocket, depending on the direction of the orbiting motion.

An early patent to Creux (U.S. Pat. No. 801,182) describes this general type of device. Subsequent patents which have disclosed scroll compressors, expanders and vacuum pumps are: U.S. Pat. Nos. 6,123,529, 6,068,459, 5,961,297, 5,855,473, 5,788,470, 5,775,893, 5,755,564, 5,690,480, 5,632,611, 5,624,247, 5,616,015, 5,556,269, 5,322,426, 5,304,047, 5,247,795, 5,171,140, 5,098,265, 4,731,000, 4,677,949, 4,558,997, 3,989,422, 3,802,809, 3,600,114, 3,560,119, 3,011,694, 2,494,100, 2,475,247, 1,041,721. These prior patents provide so-called "dual scroll" structure, i.e. the orbiting scroll elements extend from the opposite sides of the end plate. The dual scroll structure causes the axial forces acting on the end plate of the orbiting scroll from the compressed fluid pressure to be substantially reduced or balanced. Hence, the need for a thrust bearing to support the orbiting scroll is eliminated and so is the corresponding friction wear and power loss.

However, in the prior art, the orbiting scroll, no matter whether it is centrally driven or peripherally driven, makes orbiting motion with a fixed orbiting radius. U.S. Pat. No. 4,192,152 to Allen E. Armstrong et al. discloses a radial compliant linking means to accommodate the thermal expansion differences between the scroll members and frame of the housing. This so-called "radial compliant" linking means is not a true radial compliant mechanism in the sense of being typically and commonly accepted in the industry. A typical "radial compliant mechanism" refers to a mechanism that can provide the orbiting scroll with freedom to travel radially until flank-flank contact between the orbiting scroll and the fixed scroll takes place to seal off the compression or expansion pocket. When incompressible fluid is trapped in the compression pocket or debris is involved between the scrolls, the orbiting scroll can yield radially backwards from the fixed scroll to accommodate the situation.

U.S. Pat. No. 3,817,664 discloses a pivot shaft and coupling means, i.e. a mechanical radial compliant mechanism, where the orbiting scroll is compliant radially through a coupling mechanism driven by a pivot shaft, which in turn is urged by a mechanical spring. This patent also discloses an axial compliant mechanism where the orbiting scrolls are urged towards the fixed scroll to achieve tip-base contact between scrolls by the pressure of the discharge fluid for better radial sealing. This radial compliant mechanism is not practical due to the pivotal shaft and is not convenient for high rotation speed, such as a couple of thousand RPM (revolutions per minute) or higher.

In oil-free and large horsepower applications, due to the severe working conditions for the former and heavy load for the later, both call for stronger anti-rotation and coupling mechanisms than an Oldham ring mechanism, which is currently widely used in air conditioning and oil flooded scroll applications. The peripheral crank handles, as taught in U.S. Pat. No. 3,802,809, provide a strong and reliable anti-rotation and coupling mechanism. However, it restricts the orbiting scroll from radial compliance, thus sacrificing the tangential sealing between the fluid pockets formed between orbiting and fixed scrolls.

SUMMARY OF THE INVENTION

To overcome the shortcomings of conventional scroll-type fluid displacement apparatus, the present invention provides a "floating scroll" mechanism for scroll type fluid displacement apparatus. The dual orbiting scroll has spiral vanes on both sides of the end plate. In a floating scroll, the orbiting scroll is dynamically well balanced, axially and radially. The scrolls are fully or semi-axially and radially compliant for maintaining minimum contacting forces between components, hence achieving good sealing for high speed, high efficiency, low friction wear and power loss. A crank shaft-sliding knuckle and/or peripheral crank handles-sliding knuckle mechanism provide the dual orbiting scroll with radial compliant capability. A synchronizer is used to synchronize the orientation of the crank handles to prevent the mechanism from jamming during operation and start up. The scroll can be single stage or multi-stage, depending on the compression ratio, working media and other factors of the applications.

An object of the invention is to provide an improved scroll-type positive fluid displacement apparatus, which uses peripheral multiple crank handles to assure the circular translation, i.e. orbiting motion, of the orbiting scroll relative to the fixed scroll. At the same time, the scroll-type apparatus provides the orbiting scroll with the freedom to adjust its orbiting radius compliant to the fixed scroll spiral element by synchronizing the peripheral crank handles to eliminate possible mechanical jam of the handles.

It is another object of this invention to provide an improved scroll-type apparatus in which the orbiting scroll has spiral elements extending from the opposite sides of the end plate, a so called "Dual Orbiting Scroll". Both sides of the dual orbiting scroll are dynamically similar or identical, i.e. the axial forces acting on both sides of the dual orbiting scroll are balanced or its difference is minimized. An axial compliant mechanism, by pressurizing a plenum, urges one scroll member towards the other scroll member with a controlled axial force that is just enough to overcome the opposite forces to maintain very light tip-base contact and thus, to achieve the radial sealing. The orbiting scroll with axial and radial compliant mechanisms is "floating" in the sense of force balance. The floating scroll technology allows the scroll apparatus to operate at higher rotating speeds to achieve higher fluid displacement capacity with a relatively small size and weight of the apparatus. This results in a reduced friction, reduced wear, highly efficient, compact and light scroll-type fluid displacement apparatus.

Other objects of the invention will in part be obvious and will in part be apparent hereinafter.

BRIEF DESCRIPTION OF THE DRAWINGS

For a fuller understanding of the nature and objects of the invention, reference should be made to the following detailed description taken in connection with the accompanying drawings in which.

DETAILED DESCRIPTION OF THE PREFERRED EMBODIMENT(S)

Figure 1:
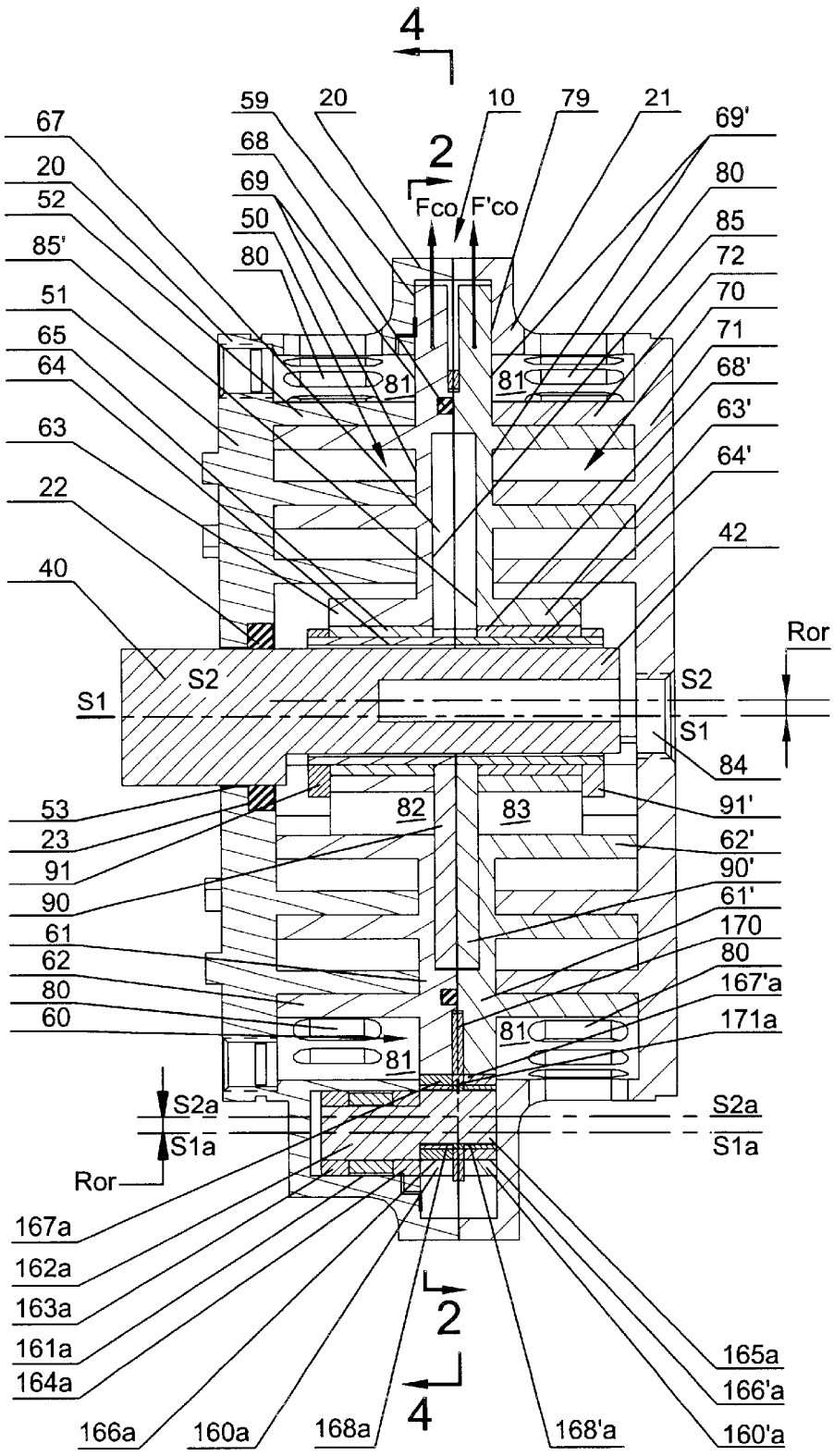
FIG. 1 is a cross-sectional view of a fully compliant floating scroll compressor in accordance with this invention.

Referring to FIG. 1, a scroll-type air compressor designed in accordance with the present invention is shown. The compressor unit 10 includes a front housing 20 and a rear housing 21. A main shaft 40 rotates along its axis S1—S1 when supported and driven by an external means (not shown). A drive pin 42 extrudes from the front end of main shaft 40, and the central axis of drive pin 42, S2—S2, is offset from the main shaft axis, S1—S1, by a distance equal to the orbiting radius $R_{or}$ of the orbiting scroll member 60. The orbiting radius is the radius of the orbiting circle, which is traversed by the orbiting scroll member 60 as it orbits relative to the first fixed scroll member 50 and the second fixed scroll member 70.

The first fixed scroll member 50 (also called front fixed scroll) has an end plate 51 from which a scroll element 52 extends. There is a hole 53 in the center of the end plate 51 to allow the main shaft 40 to pass through to drive the orbiting scroll 60.

The orbiting scroll member 60 includes circular end plates 61 and 61', scroll elements 62 and 62' affixed to and extending from opposite sides of the end plates 61 and 61', respectively, and orbiting bearing hubs 63 and 63' affixed to and extending in the central portion of the end plates 61 and 61', respectively. For convenience, the part that includes end plate 61, element 62 and hub 63 is designated as the front orbiting scroll, and end plate 61', element 62' and hub 63' as the rear orbiting scroll. Orbiting scroll 60, containing front and rear orbiting scrolls arranged back to back, is called dual scroll. The front and rear orbiting scrolls of the dual scroll orbit together and can make radial movement relative to each other during operation.

The second fixed scroll member 70 (also called rear fixed scroll) has an end plate 71, from the front side of which a scroll element 72 extends.

Scroll elements 52 and 62, 62' and 72 are interfitted at an 180 degree angular offset, and at a radial offset having an orbiting radius Ror respectively. At least one sealed off fluid pocket is thereby defined between scroll elements 52 and 62, and end plates 51 and 61. And the same is true between scroll elements 62' and 72, and end plates 61' and 71.

The working fluid enters the compressor 10 from the inlet port 80 and then enters the inlet air passage 81. The inlet air passage 81 is formed between the front housing 20, the rear housing 21 and the scrolls as shown in FIG. 1. The working fluid is then sucked into the compression pockets formed between the scrolls and is compressed during the orbiting motion of the scrolls, and finally, discharges through passage 82, 83 and discharge port 84 at the central portion of the end plate 71 of the rear fixed scroll. A shaft seal 22 is located in the seal recess 23 in the first end plate 51 to seal off the discharge gas in the passage 82 from the ambient.

Figure 2:
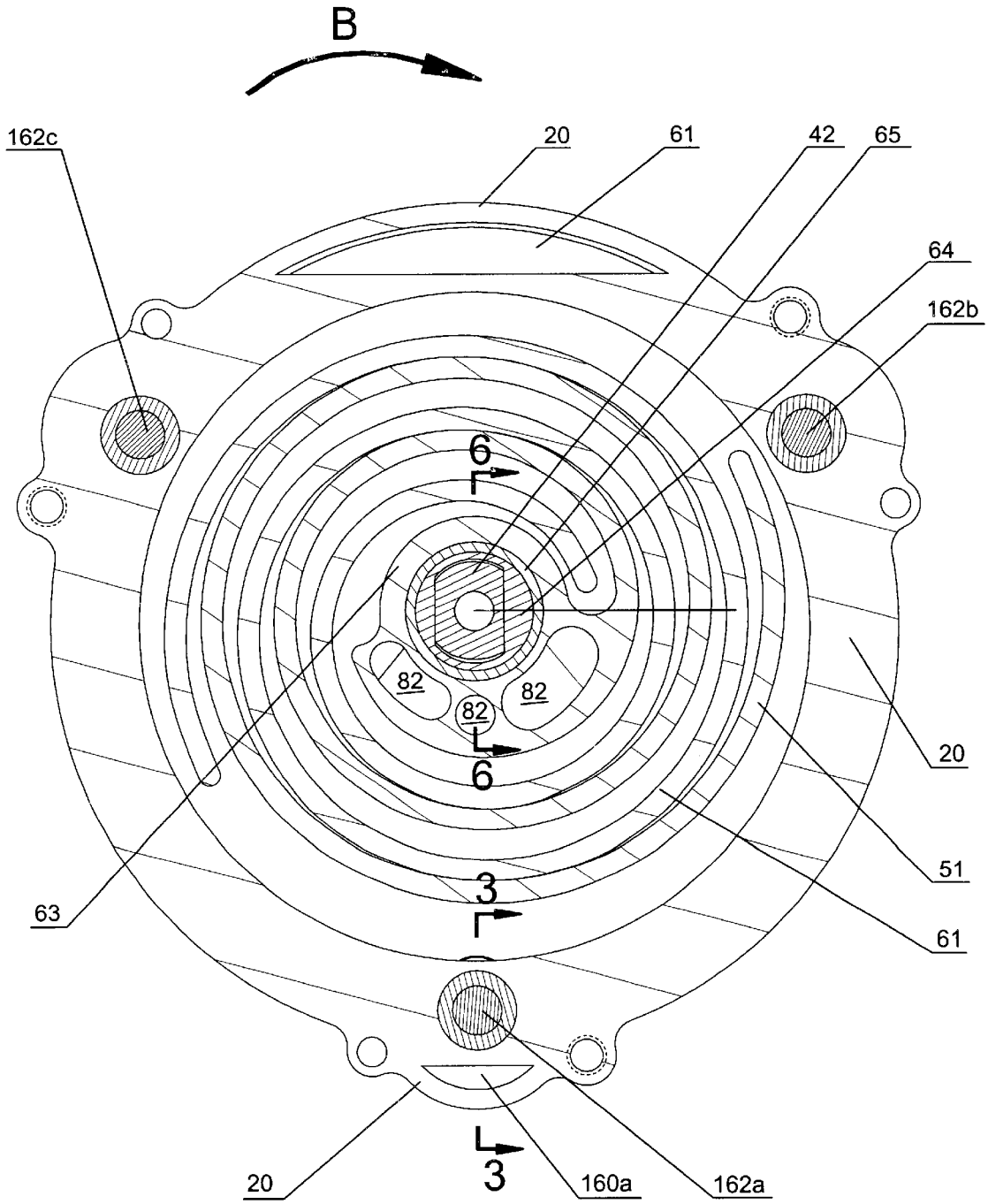
FIG. 2 is a traverse sectional view of the orbiting scroll member with a radial compliant mechanism of the present invention of FIG. 1 taken along line 2—2.

Referring to FIGS. 1–5, the driving, anti-rotation and radial compliant mechanisms are explained. The drive pin 42 of the main shaft 40 drives the orbiting scroll 60 via central driving knuckles 64 and 64' and driving pin bearing 65 and 65', respectively. At the periphery of the orbiting scroll 60, there are three pairs of equally spaced peripheral extensions 160*a*, 160*b* and 160*c* from end plate 61 and 160'*a*, 160'*b* and 160'*c* from end plate 61', respectively as shown in FIGS. 1 and 2. For simplicity, only the functions for extension 160*a* and 160'*a*, and the relevant parts, are described. The rest function in a similar and are not separately described.

Figure 3:
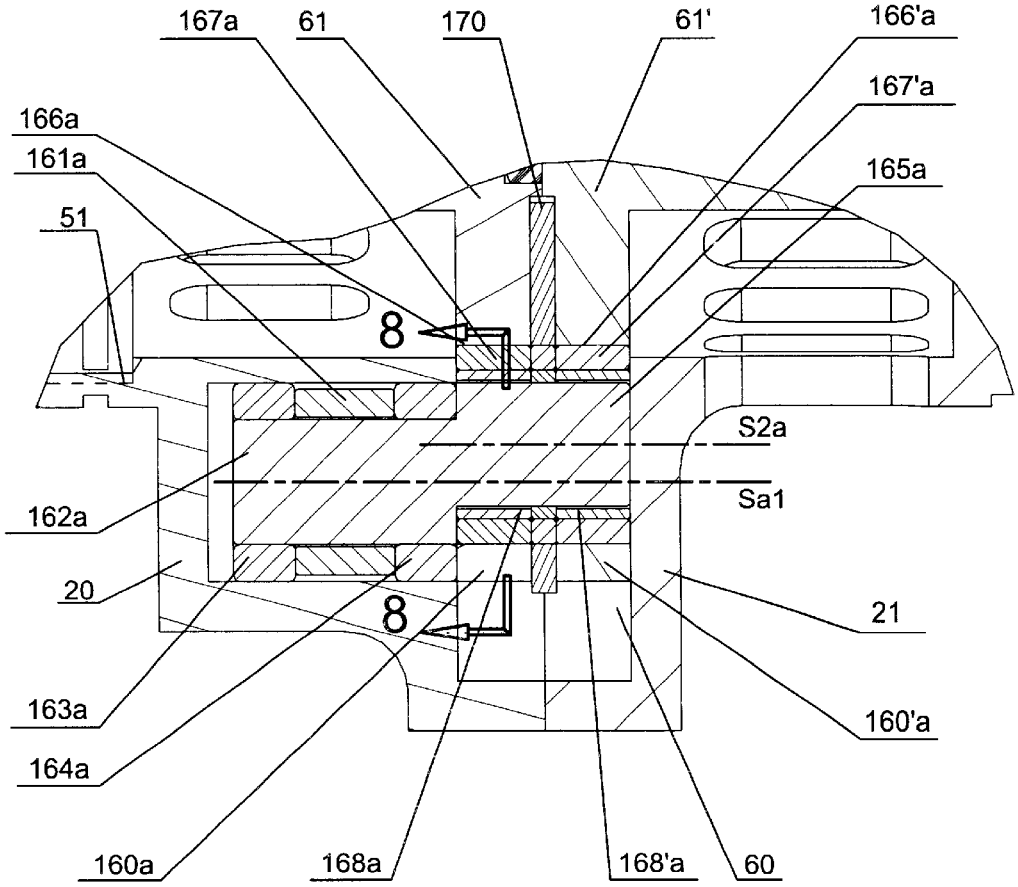
FIG. 3 is an amplified view of a peripheral crank handle, crank handle knuckle and synchronizer ring taken along line 3—3 of FIG. 2.

Referring to FIGS. 1, 2 and 3, there are three bearing holes 161*a*, 161*b* and 161*c* in the front housing 20 (only 161*a* shown). The crank handle 162*a* is rotatably supported by two bearings 163*a* and 164*a*. Crank handle pin 165*a* extrudes from crank handle 162*a*. The centerline S1*a* of the crank handle 162*a* and centerline S2*a* of the crank handle pin 165*a* are offset at a distance corresponding to the orbiting radius Ror.

Extensions 160*a* and 160'*a* of the orbiting scroll 60 have bearing holes 166*a* and 166'*a* where crank handle bearings 167*a* and 167'*a* are located, respectively. Peripheral crank handle 162*a* through crank handle pin 165*a*, peripheral crank knuckles 168*a* and 168'*a*, and handle bearings 167*a* and 167'*a* together with the other two pairs of peripheral handles 162*b* and 162*c*, and their corresponding parts keep the orbiting scroll 60 in orbiting motion and prevent it from rotation.

Figure 7:
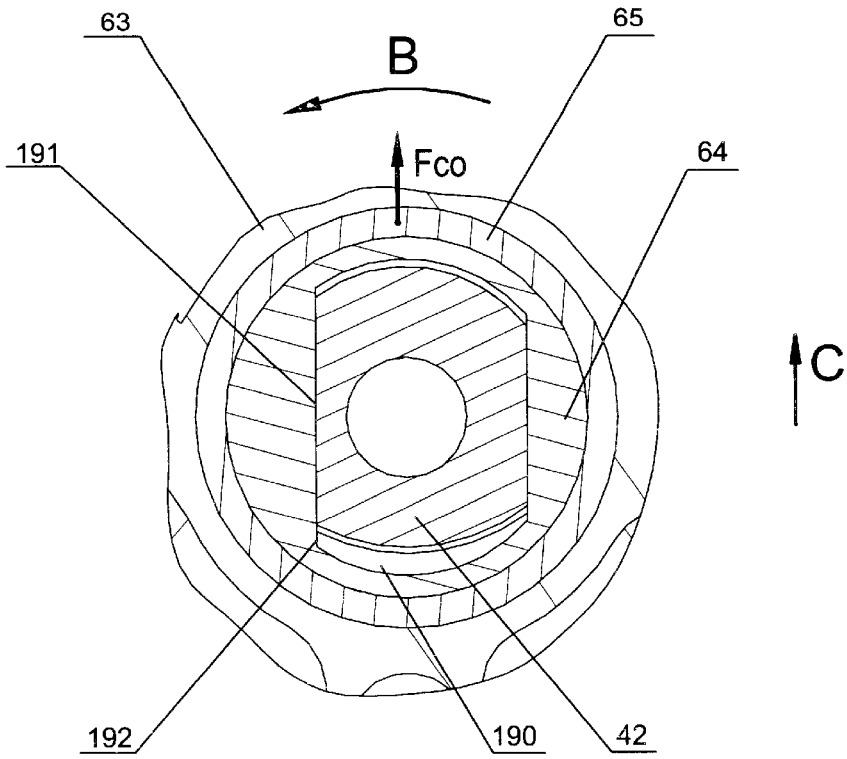
FIG. 7 is a traverse sectional view of the driving mechanism of FIG. 6 along line 7—7.

Referring to FIG. 7, there is a slot 190 in the front driving knuckle 64. The driving pin 42 is located in slot 190. The slot 190 is longer radially than the driving pin 42. When the driving pin 42 rotates counter-clockwise as shown by arrow B, the driving surface 191 of the driving pin 42 pushes the sliding surface 192 of the front driving knuckle 64. The driving knuckle 64 can move radially, as shown by arrow C. The above description is also true for the rear driving knuckle 64' and relevant parts, and for the peripheral knuckles 168*a*, 168'*a*, 168*b*, 168'*b*, 168*c*, 168'*c* and relevant parts.

Figure 8:
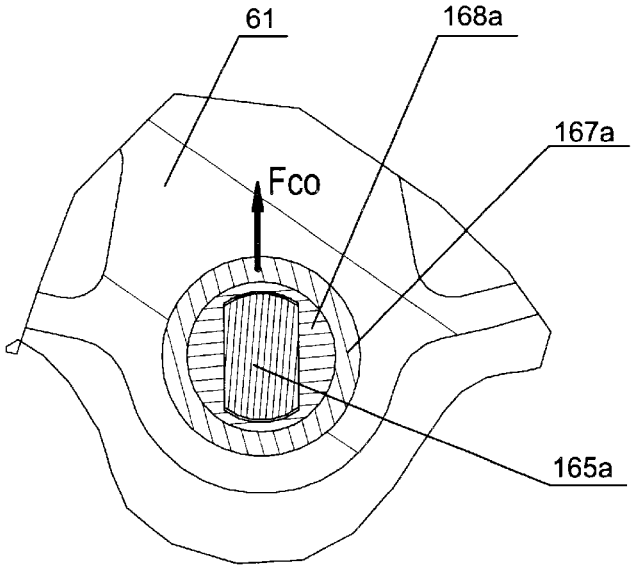
FIG. 8 is a traverse sectional view of the peripheral crank handle mechanism of FIG. 3 along line 8—8.

Referring to FIGS. 1, 7 and 8, when shaft 40 rotates, the front and rear orbiting scrolls of orbiting scroll 60 are exerted upon by centrifugal forces Fco and F'co, respectively, generated by their own orbiting motion. In addition to the orbiting motion, the front and rear orbiting scrolls of the orbiting scroll 60 slide radially together with the driving knuckle 64 and 64' and the peripheral knuckles 168*a*, 168'*a*, 168*b*, 168'*b*, 168*c* and 168'*c* under the action of the centrifugal forces until the orbiting scrolls stop by flank-flank contacting their corresponding fixed scrolls. As a result, this is radial-compliant.

Figure 4:
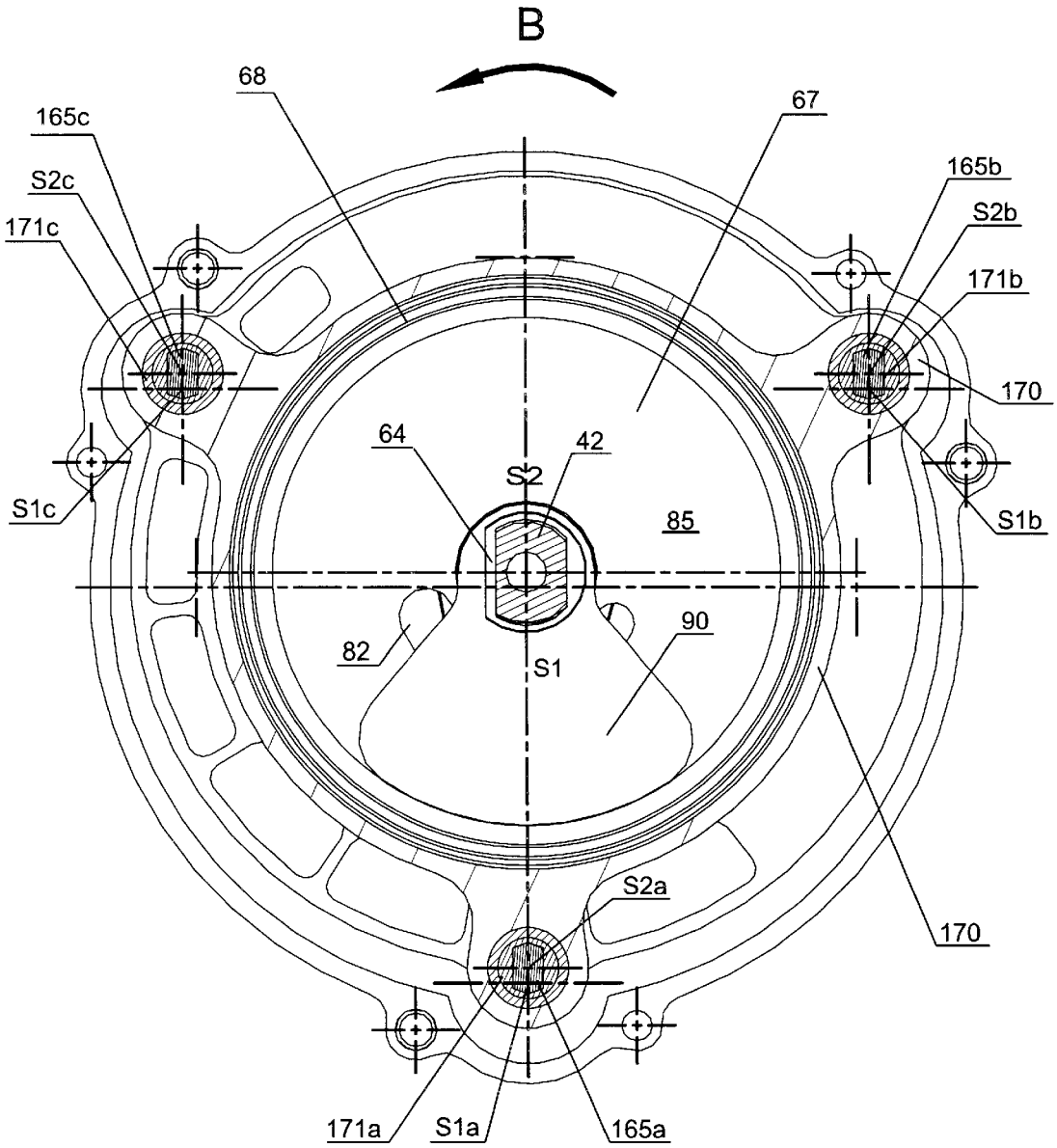
FIG. 4 is a traverse sectional view of FIG. 1 taken along line 4—4, illustrating the synchronizer, balancer and plenum of the present invention.
Figure 5:
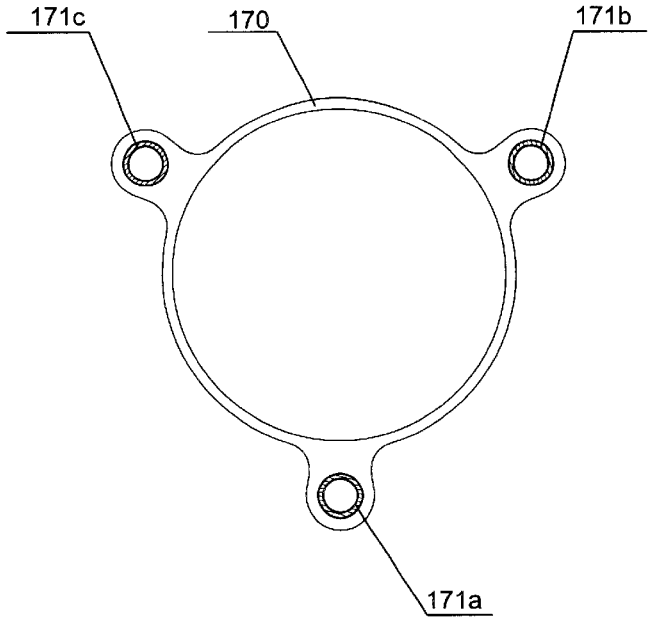
FIG. 5 is a drawing of the synchronizer ring with synchronizer bearings.
Figure 6:
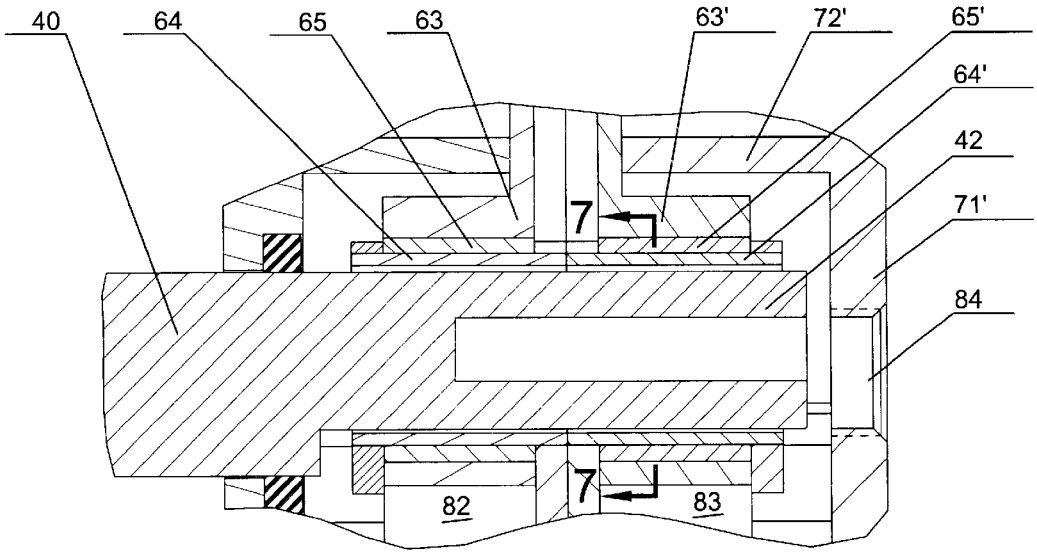
FIG. 6 is an amplified view of the driving mechanism of the central portion taken along line 6—6 of FIG. 2.

Using a sliding knuckle-crank shaft mechanism to achieve radial compliance is well known in the art. However, due to technical difficulties this mechanism has not been adapted for a dual scroll design as reviewed in the background introduction above. The difficulty is to synchronize the orientation of the peripheral crank handles, such that the orbiting scroll can slide freely in the radial direction without jamming. The invention provides a mechanism, including peripheral crank handles, sliding knuckles and a crank handle synchronizer, which makes the orbiting scroll radial compliant. Referring to FIGS. 1–5 the function of the synchronizer 170 is explained. In FIG. 4, S1*a*–S2*a*, S1*b*–S2*b* and S1*c*–S2*c* are the lines connecting the centers of crank handles 162*a*, 162*b* and 162*c* with the centers of the crank handle pins 165*a*, 165*b* and 165*c*, respectively. The lines S1*a*–S2*a*, S1*b*–S2*b* and S1*c*–S2*c* must remain parallel to each other, i.e. synchronized, all the time no matter whether the scroll apparatus is in operation or at rest. Otherwise, the crank handles 162*a*, 162*b* and 162*c*, and the driving shaft 40, and in turn the orbiting scroll 60, could be jammed at start up or during operation due to the freedom of motion of each knuckle in its radial and tangential directions.

In order to maintain the synchronization of the crank handles, synchronizer 170, as shown in FIGS. 1–5, is connected to the crank handle pins 165*a*, 165*b* and 165*c* via synchronizer bearings 171*a*, 171*b* and 171*c*, respectively. The synchronizer 170 makes circular translation, i.e. orbiting motion similar to the orbiting scrolls, and keeps the three crank handle pins in a triangular relation, i.e. being synchronized, such that the lines S1*a*–S2*a*, S1*b*–S2*b* and S1*c*–S2*c* remain parallel to each other all the time.

Returning now to the orbiting scroll 60, which is acted on by the centrifugal force Fco and F'co, and referring to FIGS. 1 and 4, the centrifugal forces Fco and F'co are partially balanced by that of counterweights 90 and 91, and 90' and 91', respectively, such that the resulting net centrifugal forces are just enough to overcome the radial separating forces caused by the compressed gas. During operation, because the lines S1*a*–S2*a*, S1*b*–S2*b* and S1*c*–S2*c* are synchronized, the orbiting scroll 60 will move along the radial direction, i.e. parallel to lines S1*a*–S2*a*, S1*b*–S2*b* and S1*c*–S2*c*, by the net centrifugal forces until the flanks of orbiting scroll elements 62 and 62' very lightly contact the flanks of the fixed scroll elements 52 and 72, respectively, to achieve tangential sealing between the compression pockets. Overall balance of centrifugal forces of the scroll apparatus is achieved by other counterweights in a traditional way, and is not discussed here.

Referring to FIGS. 1 and 4, the axial compliant mechanism for the dual scroll structure will be described. The orbiting scroll 60 includes front end plate 61 and rear end plate 61'. There is a plenum chamber 67 formed between the two end plates. Sealing element 68 seals off plenum chamber 67 from air passage 81 and suction ambient. At start up, the elasticity of the sealing element 68 urges both front and rear orbiting scrolls towards their corresponding mating fixed scrolls to achieve light tip-base contact between the mating scrolls. The plenum chamber 67 is connected to the discharge air through passages 82 and 83. The areas of the surfaces 85 and 85' are so designed that the forces of the discharge air acting on them slightly exceed the total axial forces, respectively acting on the opposite surfaces 69 and 69' of the end plates 61 and 61', and the tips of the scroll elements 62 and 62' of the front and rear orbiting scrolls by the compressed air. The net axial forces will urge the front and rear orbiting scrolls, respectively, towards the corresponding mating fixed scrolls to achieve very light contact at six pairs of contacting surfaces. Among them, two pairs of contacting surfaces are between the tip surfaces of two orbiting scrolls against the mating base surfaces of the end plates of corresponding fixed scrolls. Two other pairs of contacting surfaces are between the tip surfaces of two fixed scrolls against the mating base surfaces of the end plates of corresponding orbiting scrolls. The remaining two pairs of contacting surfaces are the anti-thrust surfaces 59 and 79 of the front and rear housings 20 and 21 against the thrust surfaces 69 and 69' of the front and rear orbiting scrolls, respectively. The anti-thrust surfaces 59 and 79 support the surfaces 69 and 69' of the orbiting scroll, respectively, to avoid possible tipping motion of the orbiting scrolls. The surface contact between the mating surfaces of the above-mentioned six pairs of contacting surfaces is not necessarily taking place at the same time when assembled. Nevertheless, after wearing-in, light contact between the six pairs of surfaces will take place. This axial compliant mechanism enables a good radial sealing between compression pockets and makes the wear between the orbiting and fixed scrolls negligible and self-compensating. Many axial compliant schemes have been taught in the prior art, and some of them might be adapted for use with this invention.

Figure 9:
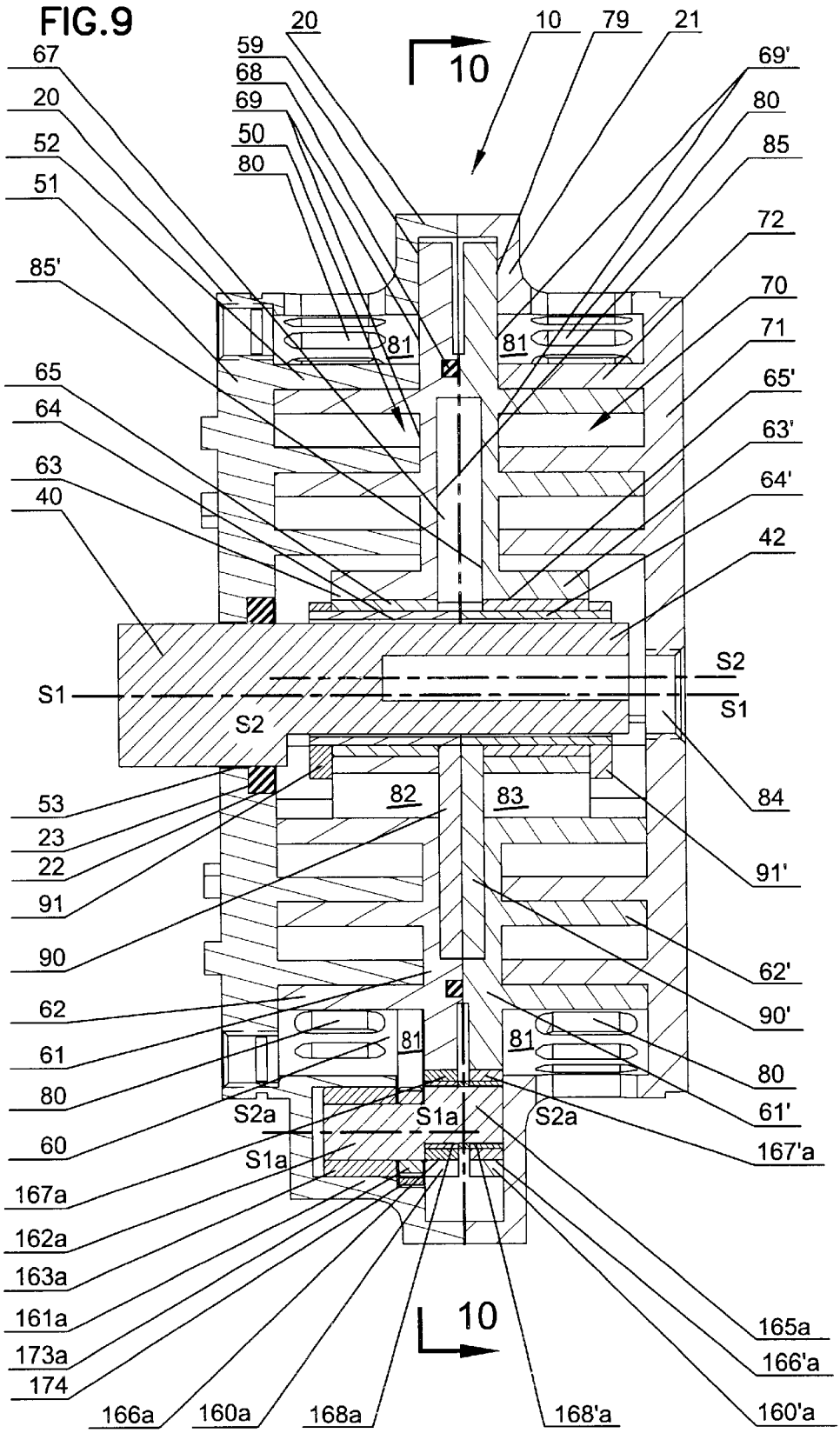
FIG. 9 is a cross-sectional view of a second embodiment of a synchronizer, timing belt and peripheral crank pulleys.
Figure 10:
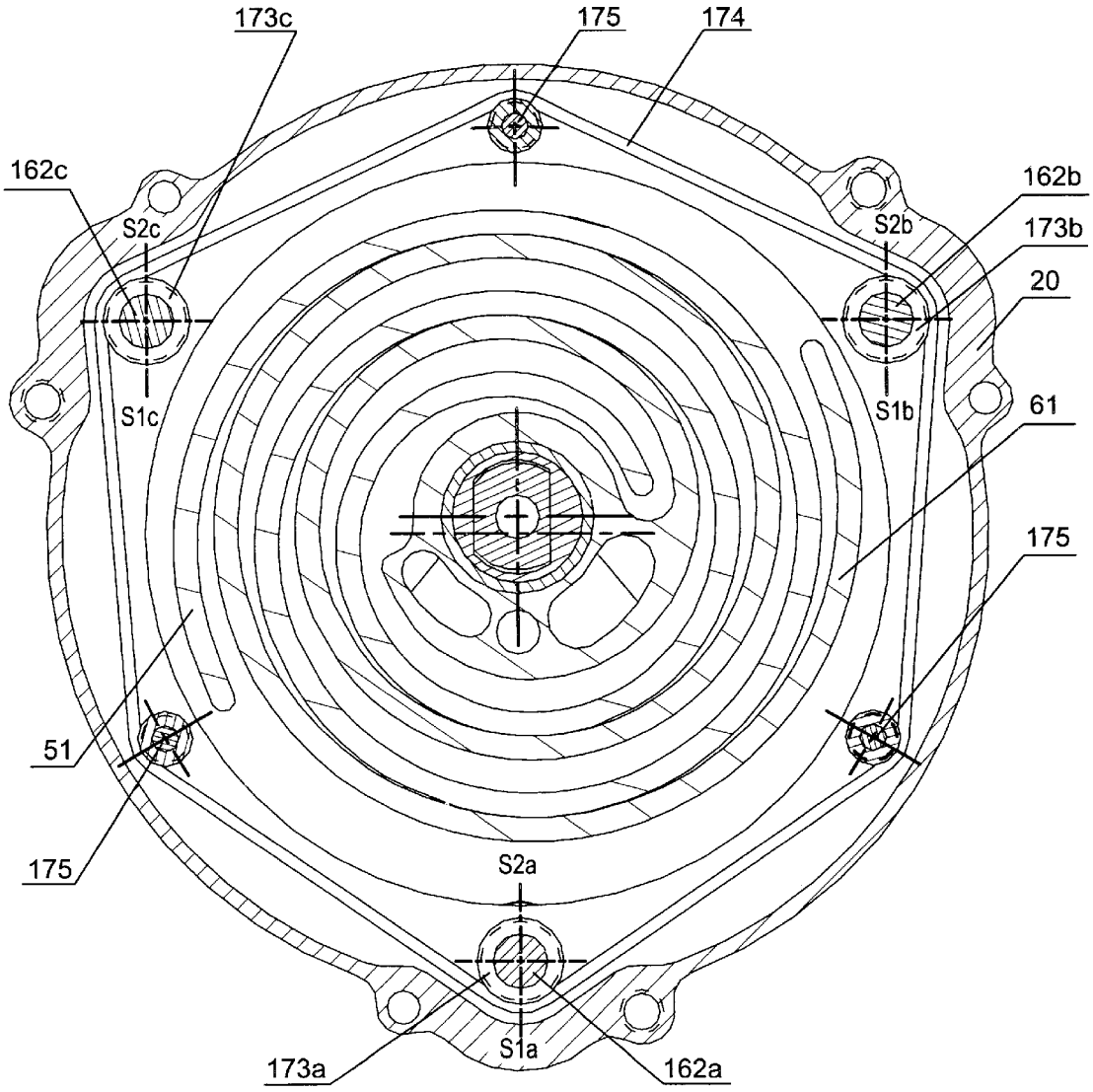
FIG. 10 is a traverse sectional view of the second embodiment of the synchronizer of the floating scroll compressor taken from FIG. 9 along line 10—10.

FIGS. 9 and 10 illustrate another embodiment of the synchronizer for a radial compliant mechanism with a dual scroll structure. In these figures, elements corresponding to elements in FIGS. 1–8 are referenced by the same reference numerals.

In this embodiment there are three peripheral crank timing pulleys, 173*a*, 173*b* and 173*c*, firmly attached to the crank handles 162*a*, 162*b* and 162*c*, respectively. A timing belt 174 links the three timing pulleys, 173*a*, 173*b* and 173*c* and synchronizes them such that the lines S1*a*–S2*a*, S1*b*–S2*b* and S1*c*–S2*c*, that connect the centers of the crank handles, 162*a*, 162*b* and 162*c* with the centers of the crank handle pins 165*a*, 165*b* and 165*c*, respectively, remain parallel to each other all the time no matter whether the scroll apparatus is in operation or is stationary. Idle wheels 175 keep the timing belt 174 in position and maintain proper tension for smooth running.

There are many mechanisms, e.g. gear systems, etc., that could alternatively be used as a synchronizer as long as they can keep the lines S1*a*–S2*a*, S1*b*–2*b* and S1*c*–S2*c* parallel to each other all the time no matter whether the scroll apparatus is in operation or is stationary.

Figure 11:
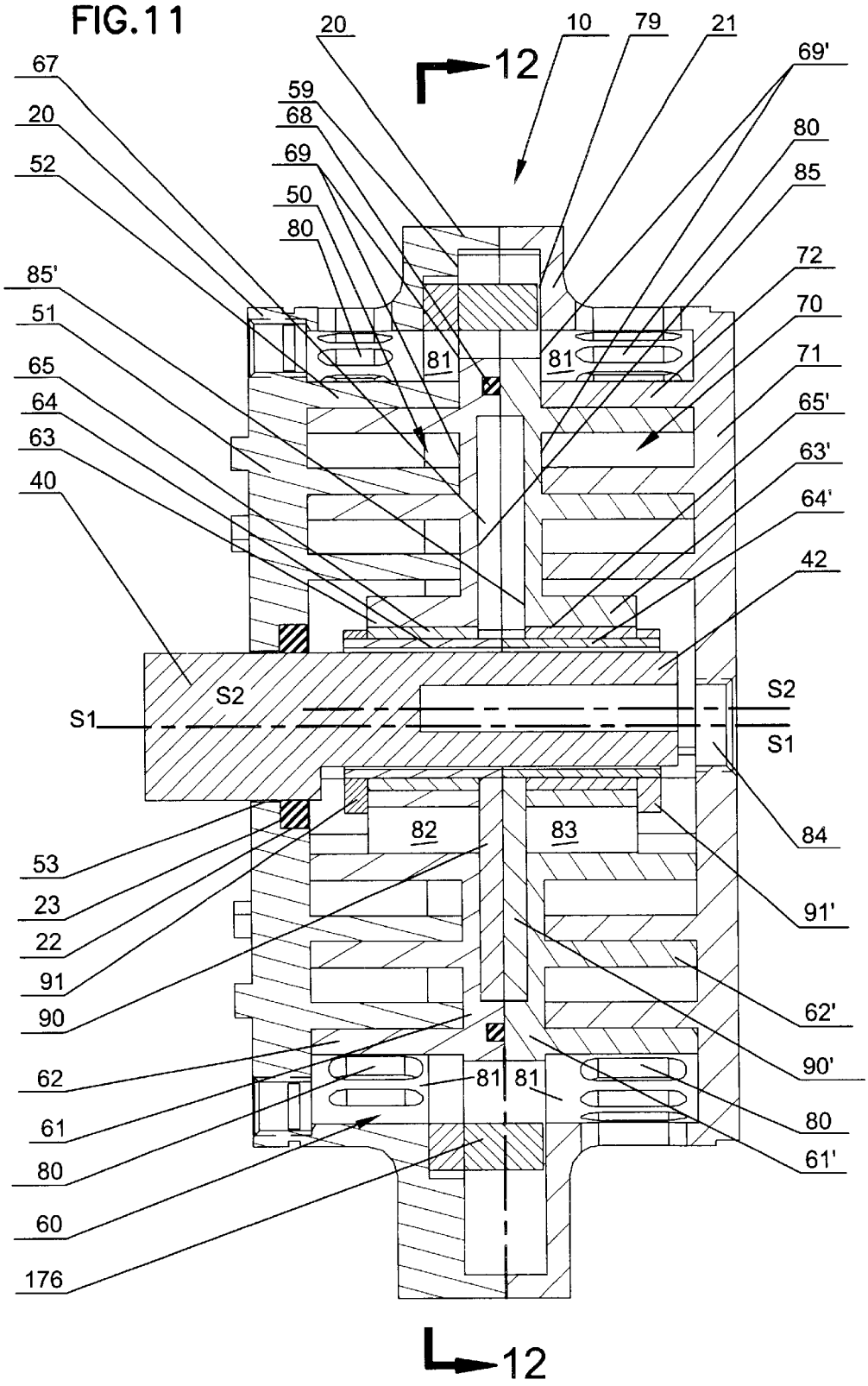
FIG. 11 is a cross-sectional view showing a floating scroll compressor with an Oldham ring as the coupling and anti-rotation mechanism.
Figure 12:
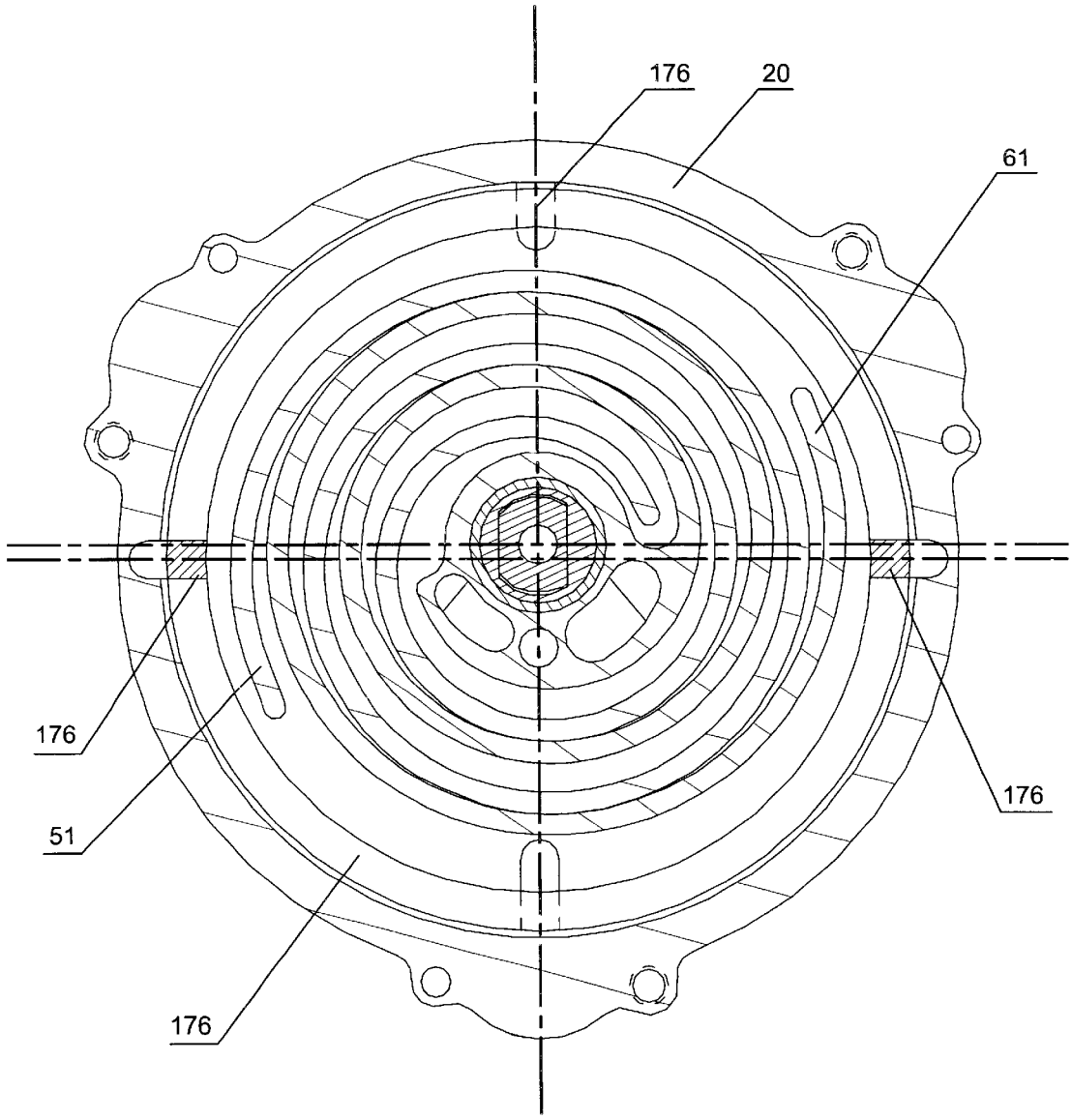
FIG. 12 is another traverse sectional view showing a floating scroll compressor with an Oldham ring as the coupling and anti-rotation mechanism taken from FIG. 11 along line 12—12.

FIGS. 11 and 12 illustrate still another embodiment of a radial compliant mechanism for a floating scroll apparatus where an Oldham ring mechanism is used as the coupling and rotation-prevention mechanism instead of the peripheral crank handle mechanism discussed above. In this embodiment, elements corresponding to elements in FIGS. 1–10 are referenced by the same reference numerals When shaft 40 rotates, the crank pin 42 drives the orbiting scroll 60 via driving knuckles 64 and 64', and driving bearings 65 and 65' to make counterclockwise circular translation, i.e. orbiting motion, and allowing radial movement between the orbiting scroll member 60 and the crank pin 42. Oldham ring 176 guides the orbiting motion of the orbiting scroll member 60. The work principle of the Oldham ring is well known in the art and further explanation is not necessary. A key point of this embodiment is to allow the front and rear orbiting scrolls to make independent radial travel under the influence of the centrifugal forces. Thus, the radial flank-flank contacts between the mating fixed and orbiting scrolls can be achieved.

While the above-described embodiments of the invention are preferred, those skilled in this art will recognize modifications of structure, arrangement, composition and the like which do not part from the true scope of the invention. The invention is defined by the appended claims, and all devices and/or methods that come within the meaning of the claims, either literally or by equivalents, are intended to be embraced therein.

What is claimed is:

1. A positive fluid displacement apparatus, comprising:

a) an orbiting scroll member including an end plate having two involute wraps affixed to opposite surfaces of said end plate and three, equally-spaced peripheral extensions;

b) first and second oppositely disposed, fixed scroll members, each fixed scroll member including an end plate having an involute wrap affixed to an internal facing surface of the respective plate, each involute wrap of the fixed scroll members engageable respectively with one involute wrap of said orbiting scroll member, wherein when said orbiting scroll member orbits with respect to said fixed scroll members, flanks of said engaged wraps of the orbiting and fixed scroll members along with the end plate of said orbiting scroll member and the internal facing surfaces of said end plates of said fixed scroll members define moving pockets of variable volume and zones of high and low fluid pressures;

c) a housing supporting said first and second fixed scroll members;

d) a rotatable shaft within said housing arranged to drive said orbiting scroll member in orbiting motion with respect to said fixed scroll members;

e) three equally spaced crank handles, each rotatably supported by said housing;

f) radially compliant linking means connecting said shaft to said orbiting scroll member and connecting said crank handles to said peripheral extensions of said orbiting scroll member to maintain a predetermined angular relationship between said orbiting and fixed scroll members and to allow said orbiting scroll member to slide radially to effect tangential sealing between said involute wraps of the orbiting and fixed scroll members which make moving line contact as said orbiting scroll member is driven.

2. A positive fluid displacement apparatus in accordance with claim 1, wherein said end plate of said orbiting scroll member comprises a front plate and a rear plate ranged back to back; said two involute wraps of said orbiting scroll member are affixed to and extend from opposite sides of the front and rear plates, respectively, and said orbiting scroll member comprises a front orbiting scroll member that includes said front plate and said attached involute wrap, and a rear orbiting scroll member tat includes said rear plate and said attached involute wrap.

3. A positive fluid displacement apparatus in accordance with claim 2, wherein said front orbiting scroll member and said rear orbiting scroll member are able to slide radially with respect to each other while orbiting.

4. A positive fluid displacement apparatus in accordance with claim 3, wherein:

a) said shaft has a crank pin extending from an end thereof;

b) a front bearing hub and a rear bearing hub are attached to a central portion of said front and rear plates, respectively, of said orbiting scroll member; and c) said radially compliant linking means having front and rear drive knuckles that are rotatable within said front and rear bearing hubs of said orbiting scroll member, said knuckles are driven by and rotate together with said crank pin and are able to slide radially together with said front and rear bearing hubs, respectively, to effect tangential sealing between said involute wraps of the orbiting and fixed scroll members which make moving line contact as said orbiting scroll member is driven.

5. A positive fluid displacement apparatus in accordance with claim 4, wherein:

a) each of said crank handles has a crank handle pin affixed to and extending from an end thereof; and b) said radially compliant linking means further includes three pairs of crank handle knuckles that are rotatable within said three peripheral extensions, respectively, of said orbiting scroll member, and are driven by and rotate together with said crank handle pins, and said crank handle knuckles are able to slide radially together with said peripheral extensions, respectively, to effect tangential sealing between said involute wraps of the orbiting and fixed scroll members which make moving line contact as said orbiting scroll member is driven and to maintain a predetermined angular relationship between said orbiting and fixed scroll members.

6. A positive fluid displacement apparatus in accordance with claim 4, wherein at least one counterbalancer is attached to each of said front and rear drive knuckles to balance part of the centrifugal forces acting on said front and rear orbiting scroll members such that a radial separating force caused by displaced gas is overcome to maintain light contact between the involute wraps of said orbiting and fixed scroll members.

7. A positive fluid displacement apparatus in accordance with claim 5, wherein at least one counterbalancer is attached to each of said three crank handle knuckles engaged with said extensions, such that a part of the centrifugal force acting on said front and rear orbiting scroll members is balanced and a radial separating force caused by displaced gas is overcome to maintain light sealing contact between the involute wraps of said orbiting and fixed scroll members.

8. A positive fluid displacement apparatus, comprising:

a) an orbiting scroll member including an end plate having two involute wraps affixed to opposite surfaces of said end plate and three, equally-spaced peripheral extensions;

b) first and second oppositely disposed, fixed scroll members, each fixed scroll member including an end plate having an involute wrap affixed to an internal facing surface of the respective plate, each involute wrap of the fixed scroll members engageable respectively with one involute wrap of said orbiting scroll member, wherein when said orbiting scroll member orbits with respect to said fixed scroll members, flanks of said engaged wraps of the orbiting and fixed scroll members along with said end plate of said orbiting scroll member and the internal facing surfaces of said end plates of said fixed scroll members define moving pockets of variable volume and zones of high and low fluid pressures;

c) a housing supporting said first and second fixed scroll members;

d) a rotatable shaft within said housing arranged to drive said orbiting scroll member in orbiting motion with respect to said fixed scroll members;

e) three equally spaced crank handles, each rotatably supported by said housing;

f) radially compliant linking means connecting said shaft to said orbiting scroll member and connecting said crank handles to said peripheral extensions of said orbiting scroll member to maintain a predetermined angular relationship between said orbiting and fixed scroll members and to allow said orbiting scroll member to slide radially to effect tangential sealing between said involute wraps of said orbiting and fixed scroll members which make moving line contact as said orbiting scroll member is driven;

g) a synchronizer synchronizing said crank handles such that in a plane perpendicular to said rotatable shaft, lines drawn through centers of said crank handles and perpendicular to the direction of orbiting motion of said orbiting scroll member remain parallel.

9. A positive fluid displacement apparatus in accordance with claim 8, wherein said synchronizer has a ring with three, equally-spaced peripheral extensions connected to said crank handles, and said synchronizer orbits together with said orbiting scroll member.

10. A positive fluid displacement apparatus in accordance with claim 9, wherein said end plate of said orbiting scroll member comprises a front plate and a rear plate arranged back to back; said two involute wraps of said orbiting scroll member are affixed to and extend from opposite sides of the front and rear plates, respectively; and said orbiting scroll member comprises a front orbiting scroll member that includes said front plate and said attached involute wrap, and a rear orbiting scroll member that includes said rear plate and said attached involute wrap.

11. A positive fluid displacement apparatus in accordance with claim 10, wherein said front orbiting scroll member and said rear orbiting scroll member are able to slide radially with respect to each other while orbiting.

12. A positive fluid displacement apparatus in accordance with claim 11, wherein:

a) said shaft has a crank pin extending from an end thereof;

b) a front bearing hub and a rear bearing hub are attached to a central portion of said front and rear plates, respectively, of said orbiting scroll member; and c) said radially compliant linking means having front and rear drive knuckles that are rotatable within said front and rear bearing hubs of said orbiting scroll member, said knuckles are driven by and rotate together with said crank pin and are able to slide radially together with said front and rear bearing hubs, respectively, to effect tangential sealing between said involute wraps of the orbiting and fixed scroll members which make moving line contact as said orbiting scroll member is driven.

13. A positive fluid displacement apparatus in accordance with claim 12, wherein:

a) each of said crank handles has a crank handle pin affixed to and extending from an end thereof; and b) said radially compliant linking means further includes three pairs of crank handle knuckles that are rotatable within said three peripheral extensions, respectively, of said orbiting scroll member, and are driven by and rotate together with said crank handle pins, and said crank handle knuckles are able to slide radially together with said peripheral extensions, respectively, to effect tangential sealing between said involute wraps of the orbiting and fixed scroll members which make moving line contact as said orbiting scroll member is driven and to maintain a predetermined angular relationship between said orbiting and fixed scroll members.

14. A positive fluid displacement apparatus in accordance with claim 12, wherein at least one counterbalancer is attached to each of said front and rear drive knuckles to balance part of the centrifugal forces acting on said front and rear orbiting scroll members such that a radial separating force caused by displaced gas is overcome to maintain light contact between the involute wraps of said orbiting and fixed scrolls.

15. A positive fluid displacement apparatus in accordance with claim 13, wherein at least one counterbalancer is attached to each of said three crank handle knuckles engaged with said extensions, such that a part of the centrifugal force acting on said front and rear orbiting scroll members is balanced and a radial separating force caused by displaced gas is overcome to maintain light sealing contact between the involute wraps of said orbiting and fixed scroll members.

16. A positive fluid displacement apparatus, comprising:

a) an orbiting scroll member including an end plate having a front plate and a rear plate arranged back to back, and two involute wraps are affixed to and extend from opposite sides of the front and rear plates, respectively; said orbiting scroll member comprises a front orbiting scroll member tat includes said front plate and said attached involute wrap, and a rear orbiting scroll member that includes said rear plate and said attached involute wrap; and three, equally-spaced peripheral extensions for each of said front and rear plates;

b) first and second oppositely disposed, fixed scroll members, each fixed scroll member including an end plate having an involute wrap affixed to an internal facing surface of the respective plate, each involute wrap of the fixed scroll members engageable respectively with one involute wrap of said orbiting scroll member, wherein when said orbiting scroll member orbits with respect to said fixed scroll members, flanks of said engaged wraps of the orbiting and fixed scroll members along with said front and rear plates of said orbiting scroll member and the internal facing surfaces of said end plates of said fixed scroll members define moving pockets of variable volume and zones of high and low fluid pressures;

c) a housing supporting said first and second fixed scroll members;

d) a rotatable shaft within said housing arranged to drive said orbiting scroll member in orbiting motion with respect to said fixed scroll members;

e) three equally spaced crank handles, each rotatably supported by said housing;

f) radially compliant linking means connecting said shaft to said orbiting scroll member and connecting said crank handles to said peripheral extensions of said orbiting scroll member to maintain a predetermined angular relationship between said orbiting and fixed scroll members and to allow said orbiting scroll member to slide radially to effect tangential sealing between said involute wraps of said orbiting and fixed scroll members which make moving line contact as said orbiting scroll member is driven;

g) a synchronizer synchronizing said crank handles such that in a plane perpendicular to said rotatable shaft, lines drawn through centers of said crank handles and perpendicular to the direction of orbiting motion of said orbiting scroll member remain parallel; and h) a plenum chamber formed between said front and rear plates of said front and rear orbiting scroll members, wherein a pressurized fluid introduced into said plenum chamber urges the front and rear orbiting scroll members towards the fixed scroll members.

17. A positive fluid displacement apparatus in accordance with claim 16, wherein said synchronizer has a ring with three, equally-spaced peripheral extensions connected to said crank handles, and said synchronizer orbits together with said orbiting scroll member.

18. A positive fluid displacement apparatus in accordance with claim 17, wherein said front orbiting scroll member and said rear orbiting scroll member are able to slide radially with respect to each other while orbiting.

19. A positive fluid displacement apparatus in accordance with claim 18, wherein a sealing element made of resilient material is located between said front and rear plates of said front and rear orbiting scroll members to seal off said plenum chamber such that a pressurized fluid introduced into the plenum chamber is sealed off from neighboring areas containing fluid at different pressure inside said housing.

20. A positive fluid displacement apparatus in accordance with claim 19, wherein:

a) said shaft has a crank pin extending from an end thereof;

b) a front bearing hub and a rear bearing hub are attached to a central portion of said front and rear plates, respectively, of said orbiting scroll member; and c) said radially compliant linking means having front and rear drive knuckles that are rotatable within said front and rear bearing hubs of said orbiting scroll member, said knuckles are driven by and rotate together with said crank pin and are able to slide radially together with said front and rear bearing hubs, respectively, to effect tangential sealing between said involute wraps of the orbiting and fixed scroll members which make moving line contact as said orbiting scroll member is driven.

21. A positive fluid displacement apparatus in accordance with claim 20, wherein:

a) each of said crank handles has a crank handle pin affixed to and extending from an end thereof; and b) said radially compliant linking means further includes three pairs of crank handle knuckles that are rotatable within said three peripheral extensions, respectively, of said orbiting scroll member, and are driven by and rotate together with said crank handle pins, and said crank handle knuckles are able to slide radially together with said peripheral extensions, respectively, to effect tangential sealing between said involute wraps of the orbiting and fixed scroll members which make moving line contact as said orbiting scroll member is driven and to maintain a predetermined angular relationship between said orbiting and fixed scroll members.

22. A positive fluid displacement apparatus in accordance with claim 20, wherein at least one counterbalancer is attached to each of said front and rear drive knuckles to balance part of the centrifugal forces acting on said front and rear orbiting scroll members such that a radial separating force caused by displaced gas is overcome to maintain light contact between the involute wraps of said orbiting and fixed scroll members.

23. A positive fluid displacement apparatus in accordance with claim 21, wherein at least one counterbalancer is attached to each of said three crank handle knuckles engaged with said extensions, such that a part of the centrifugal force acting on said front and rear orbiting scroll members is balanced and a radial separating force caused by displaced gas is overcome to maintain light sealing contact between the involute wraps of said orbiting and fixed scroll members.

24. A positive fluid displacement apparatus, comprising in combination a) an orbiting scroll member including an end plate having a front plate and a rear plate arranged back to back, and two involute wraps are affixed to and extend from opposite sides of the front and rear plates, respectively; said orbiting scroll member comprises a front orbiting scroll member that includes said front plate and said attached involute wrap, and a rear orbiting scroll member that includes said rear plate and said attached involute wrap; and three, equally-spaced peripheral extensions for each of said front and rear plates;

b) first and second oppositely disposed, fixed scroll members, each fixed scroll member including an end plate having an involute wrap affixed to an internal facing surface of the respective plate, each involute wrap of the fixed scroll members engageable respectively with one involute wrap of said orbiting scroll member, wherein when said orbiting scroll member orbits with respect to said fixed scroll members, flanks of said engaged wraps of the orbiting and fixed scroll members along with said front and rear plates of said orbiting scroll member and the internal facing surfaces of said end plates of said fixed scroll members define moving pockets of variable volume and zones of high and low fluid pressures;

c) a housing supporting said first and second fixed scroll members;

d) a rotatable shaft within said housing arranged to drive said orbiting scroll member in orbiting motion with respect to said fixed scroll members;

e) three equally spaced crank handles, each rotatably supported by said housing, and each having a timing belt pulley attached to it;

f) radially compliant linking means connecting said shaft to said orbiting scroll member and connecting said crank handles to said peripheral extensions of said orbiting scroll member to maintain a predetermined angular relationship between said orbiting and fixed scroll members and to allow said orbiting scroll member to slide radially to effect tangential sealing between said involute wraps of said orbiting and fixed scroll members which make moving line contact as said orbiting scroll member is driven;

g) a plenum chamber formed between said front and rear plates of said front and rear orbiting scroll members, wherein a pressurized fluid introduced into said plenum chamber urges the front and rear orbiting scroll members towards the fixed scroll members; and h) a synchronizer including a timing belt and multiple idle wheels, said synchronizer synchronizing said crank handles such that in a plane perpendicular to said rotatable shaft, lines drawn through centers of said crank handles and perpendicular to the direction of orbiting motion of said orbiting scroll member remain parallel.

25. A positive fluid displacement apparatus in accordance with claim 24, wherein said front orbiting scroll member and said rear orbiting scroll member are able to slide radially with respect to each other while orbiting.

26. A positive fluid displacement apparatus in accordance with claim 25, wherein a sealing element made of resilient material is located between said front and rear plates of said front and rear orbiting scroll members to seal off said plenum chamber such that a pressurized fluid introduced into the plenum chamber is sealed off from neighboring areas containing fluid at different pressure inside said housing.

27. A positive fluid displacement apparatus in accordance with claim 26, wherein:

a) said shaft has a crank pin extending from an end thereof;

b) a front bearing hub and a rear bearing hub are attached to a central portion of said front and rear plates, respectively, of said orbiting scroll member; and c) said radially compliant linking means having front and rear drive knuckles that are rotatable within said front and rear bearing hubs of said orbiting scroll member, said knuckles are driven by and rotate together with said crank pin and are able to slide radially together with said front and rear bearing hubs, respectively, to effect tangential sealing between said involute wraps of the orbiting and fixed scroll members which make moving line contact as said orbiting scroll member is driven.

28. A positive fluid displacement apparatus in accordance with claim 27, wherein:

a) each of said crank handles has a crank handle pin affixed to and extending from an end thereof; and b) said radially compliant linking means further includes three pairs of crank handle knuckles that are rotatable within said three peripheral extensions, respectively, of said orbiting scroll member, and are driven by and rotate together with said crank handle pins, and said crank handle knuckles are able to slide radially together with said peripheral extensions, respectively, to effect tangential sealing between said involute wraps of said orbiting and fixed scroll members which make moving line contact as said orbiting scroll member is driven and to maintain a predetermined angular relationship between said orbiting and fixed scroll members.

29. A positive fluid displacement apparatus in accordance with claim 27, wherein at least one counterbalancer is attached to each of said front and rear drive knuckles to balance part of the centrifugal forces acting on said front and rear orbiting scroll members such that a radial separating force caused by displaced gas is overcome to maintain light contact between the involute wraps of said orbiting and fixed scroll members.

30. A positive fluid displacement apparatus in accordance with claim 28, wherein at least one counterbalancer is attached to each of said three crank handle knuckles engaged with said extensions, such that a part of the centrifugal force acting on said front and rear orbiting scroll members is balanced and a radial separating force caused by displaced gas is overcome to maintain light sealing contact between the involute wraps of said orbiting and fixed scroll members.

31. A positive fluid displacement apparatus, comprising:

a) an orbiting scroll member including an end plate having a front plate and a rear plate ranged back to back, and two involute wraps are affixed to and extend from opposite sides of the front and rear plates, respectively; said orbiting scroll member comprises a front orbiting scroll member that includes said front plate and said attached involute wrap, and a rear orbiting scroll member that includes said rear plate and said attached involute wrap;

b) first and second oppositely disposed, fixed scroll members, each fixed scroll member including an end plate having an involute wrap affixed to an internal facing surface of the respective plate, each involute wrap of the fixed scroll members engageable respectively with one involute wrap of said orbiting scroll member, wherein when said orbiting scroll member orbits with respect to said fixed scroll members, flanks of said engaged wraps of the orbiting and fixed scroll members along with said front and rear plates of said orbiting scroll member and the internal facing surfaces of said end plates of said fixed scroll members define moving pockets of variable volume and zones of high and low fluid pressures;

c) a housing supporting said first and second fixed scroll members;

d) a rotatable shaft within said housing arranged to drive said orbiting scroll member in orbiting motion with respect to said fixed scroll members, said shaft has a crank pin extending from an end thereof;

e) a plenum chamber formed between said front and rear plates of said front and rear orbiting scroll members, wherein a pressurized fluid introduced into said plenum chamber urges the front and rear orbiting scroll members towards the fixed scroll members;

f) an Oldham coupling having two sets of keys perpendicular to each other, each set of said keys is engaged with said orbiting scroll member and said housing, respectively, to maintain a predetermined angular relationship between said orbiting and fixed scroll members;

g) a front bearing hub and a rear bearing hub are attached to a central portion of said front and rear plates, respectively, of said orbiting scroll member; and h) a radially compliant linking means having front and rear drive knuckles that are rotatable within said front and rear bearing hubs of said orbiting scroll member, said knuckles are driven by and rotate together with said crank pin and are able to slide radially together with said front and rear bearing hubs, respectively, to effect tangential sealing between said involute wraps of said orbiting and fixed scroll members which make moving line contact as said orbiting scroll member is driven.

32. A positive fluid displacement apparatus in accordance with claim 31 wherein a sealing element made of resilient material is located between said front and rear plates of said front and rear orbiting scroll members to seal off said plenum chamber such that a pressurized fluid introduced into the plenum chamber is sealed off from neighboring areas containing fluid at different pressure inside said housing.

33. A positive fluid displacement apparatus in accordance with claim 32, wherein at least one counterbalancer is attached to each of said front and rear drive knuckles to balance part of the centrifugal forces acting on said front and rear orbiting scroll members such that a radial separating force caused by displaced gas is overcome to maintain light contact between the involute wraps of said orbiting and fixed scroll members.

* * * * *